US005151320A

United States Patent [19]

Homonoff et al.

[11] Patent Number: 5,151,320

[45] Date of Patent: Sep. 29, 1992

[54] HYDROENTANGLED SPUNBONDED COMPOSITE FABRIC AND PROCESS

[75] Inventors: Edward C. Homonoff, Brooklyn; Alan W. Meierhoefer, West Hartford, both of Conn.; Lori B. Flint, Westfield, Mass.

[73] Assignee: The Dexter Corporation, Windsor Locks, Conn.

[21] Appl. No.: 841,390

[22] Filed: Feb. 25, 1992

[51] Int. Cl.[5] ..... B32B 5/06

[52] U.S. Cl. ..... 428/284; 28/104; 28/105; 28/240; 428/286; 428/287; 428/297; 428/298; 428/299; 428/326

[58] Field of Search ..... 428/284, 286, 287, 297, 428/298, 299, 326; 28/104, 105, 240

[56] References Cited

U.S. PATENT DOCUMENTS

| | | | |
|---|---|---|---|
| 4,144,370 | 3/1979 | Boulton | 428/233 |
| 4,377,889 | 3/1983 | Tatham et al. | 28/112 |
| 4,442,161 | 4/1984 | Kirayoglu et al. | 428/219 |
| 4,501,631 | 2/1985 | Bostian, Jr. et al. | 156/161 |
| 4,525,317 | 6/1985 | Okada et al. | 264/235.8 |
| 4,542,060 | 9/1985 | Yoshida et al. | 428/287 |
| 4,612,237 | 9/1986 | Frankenburg | 428/219 |
| 4,705,712 | 11/1987 | Cashaw et al. | 428/152 |
| 4,775,579 | 10/1988 | Hagy et al. | 428/284 |
| 4,808,467 | 2/1989 | Suskind et al. | 428/284 |
| 4,810,568 | 3/1989 | Buyofsky et al. | 428/284 |
| 4,833,026 | 5/1989 | Kausch | 428/315.5 |
| 4,879,170 | 11/1989 | Radwanski et al. | 428/233 |
| 4,883,709 | 11/1989 | Nozaki et al. | 428/288 |
| 4,902,564 | 2/1990 | Israel et al. | 428/284 |
| 4,931,355 | 6/1990 | Radwanski et al. | 428/283 |
| 5,009,747 | 4/1991 | Viazmensky et al. | 162/115 |
| 5,026,587 | 6/1991 | Austin et al. | 428/299 |

*Primary Examiner*—James J. Bell
*Attorney, Agent, or Firm*—Chilton, Alix & Van Kirk

[57] ABSTRACT

A hydroentangled composite fabric is made by subjecting a spunbonded base web material of continuous man-made filaments to stretching in the cross direction at least 5 percent of its original dimension but less than the cross direction elongation of the material under ambient temperature conditions at the time of stretching. The base web material in its cross-stretched condition is stabilized to provide a prestretched base web material substantially free from cross direction tensioning. A covering layer of fluid dispersible fibers, preferably in the form of one or more wet-laid wood pulp fibrous webs, is applied to one surface of the relaxed prestretched base web to form a multilayer structure and the multilayer structure is subjected to hydroentanglement while in its relaxed condition to embed the covering fibers in the spunbonded base layer and affix the fiber layer to one surface of the prestretched base material. The resultant fabric exhibits improved dimensional stability and cross-directional strength characteristics closely approaching those in the machine direction.

20 Claims, No Drawings

HYDROENTANGLED SPUNBONDED COMPOSITE FABRIC AND PROCESS

BACKGROUND AND SUMMARY OF THE INVENTION

The present invention relates generally to hydroentangled composite nonwoven fabric and is more particularly concerned with a new and improved process for enhancing the cross direction properties of composite fabrics that use a spunbonded web as a base layer and to the new and improved products obtained thereby.

Conventional hydroentangled spunbonded composite fabrics find use as molding substrates, geotextiles and in the medical field as disposable apparel such as surgical gowns and drapes. Hydroentangled fabrics of this type are disclosed in the Suskind et al U.S. Pat. No. 4,808,467 and typically consist of a spunbonded base layer of continuous man-made filaments with one or more overlying cover layers of tissue weight material composed of a blend of wood pulp and synthetic fibers. The tissue weight cover layer is secured to the surface of the base web by hydroentanglement to provide the desired composite structure. Such materials typically have a higher strength in the machine direction than in the cross direction, this lack of squareness being particularly evident in the strip and grab tensile strengths for such materials. The ratio of tensile strengths in the machine direction versus the cross direction (MD/CD) is typically about 1.5:1 and may vary from about 1.3:1 to as high as 4:1.

Material of the type described for use as disposable medical apparel must be cut and arranged so that the strongest fabric direction is oriented to resist directional stresses caused during use by the wearer. Since the rolls of nonwoven fabric are shipped to converters who perform the cutting and sewing operations on automatic equipment, the garment components must always stay oriented with the converting equipment for proper placement in the strongest fabric direction. Consequently, the medical apparel is arranged and cut from rolls of the composite nonwoven fabric so that the strongest fabric direction is always oriented relative to the machine direction of the converting equipment. As can be appreciated, if the fabric possessed improved cross-directional strength characteristics approaching equivalency in both directions, i.e., "square" properties, garment layout and assembly would be significantly easier and less costly to the converter and less critical for wearer protection. Although some spunbonded fabrics can be manufactured to achieve these "square" properties, the manufacturing process must be altered at the time the spunbonded layer is formed, resulting in a much more expensive operation with a resultant drop in fabric productivity.

Spunlaced fabrics have also found use in medical apparel applications. They typically are made as dry-laid webs from staple textile fibers rather than continuous filaments and beneficially exhibit excellent aesthetic and liquid barrier properties but poorer cross-directional strength characteristics and therefore higher MD/CD ratios. The webs are not only fluid repellent and sterilizable but also breathable and comfortable. Examples of such spunlaced fabrics may be found in the Kirayogh et al U.S. Pat. No. 4,442,161 and the Cashaw et al U.S. Pat. No. 4,705,712. The latter patent describes a surface corrugated staple fiber spunlaced fabric having a surface layer of wood pulp that fills the holes in the hydroentangled spunlaced base web material. Before applying the surface layer, the hydroentangled spunlaced fiber web is subjected to a cross direction stretch of 5–80 percent after treating the fabric with a repellent material to lubricate the fabric and make it more easily stretched. While in the stretched and tensioned condition, the fabric is coated with an aqueous slurry of fine fibers, dewatered, and then allowed to contract, resulting in the corrugated composite fabric.

A more recent patent relating to cross-stretched spunlaced composite nonwoven fabric is the Nozaki U.S. Pat. No. 4,883,709. That patent employs a staple fiber base web material that is hydroentangled, resulting in a series of fluid jet traces formed on the layer's surface. The base layer is cross-stretched to provide greater spacing between the fluid jet traces. Shorter fibers are then applied to the stretched base web material in the form of tissue weight sheets and the multilayer structure is subjected to a further water entanglement treatment so that the subsequent water jet traces are more closely spaced from one another than the traces in the stretched base layer. The resultant composite material is said to exhibit greater dimensional stability. However, the tensile strength MD/CD ratio remains at only slightly less than 5:1 and square properties are not obtained by this operation.

The Hagy et al U.S. Pat. No. 4,775,579 teaches a method that involves stretching an elastic meltblown web material and incorporating an absorbent fiber mix by hydroentanglement, while holding the base web in its stretched condition. Following hydroentanglement, the stretched base web is released so that it can return to its original dimensions. The elastic nature of the material makes it well suited for use as an elastic bandage, support or the like. Due to the elastic nature of the filaments, the MD/CD ratio is not significantly altered by the stretching operation.

In accordance with the present invention, it has been found that improved cross direction strength characteristics approaching equivalency in both the machine and cross directions can be achieved when employing a spunbonded web as the base layer of a composite fabric. These beneficial results are achieved by subjecting the spunbonded base web to a cross stretching operation prior to forming the composite fabric.

Accordingly, it is an object of the present invention to provide a new and improved composite spunbonded fabric having enhanced cross-directional properties and a new and improved process for achieving that enhancement. Included in this object is the provision for a composite spunbonded fabric having substantially equal or square strength characteristics in both the machine and cross directions.

Another object of the present invention is to provide a new and improved composite spunbonded fabric of the type described that exhibits barrier and softness properties comparable to spunlaced fabrics while at the same time exhibiting the substantially higher cross-directional strength properties conventionally associated with spunbonded fabrics. Included in this object is the provision for a composite spunbonded fabric having improved dimensional stability coupled with significantly higher strength in the weakest fabric direction, thereby rendering the fabric stronger and more robust for its intended end use. The process for achieving these properties advantageously can be performed in a rapid and facile manner, using a relatively lower total energy input during hydroentanglement, thereby reducing the cost of the resultant composite product.

Other features and advantages of the present invention will be in part obvious and in part pointed out more in detail hereinafter.

These and related advantages are achieved in accordance with the present invention by initially providing a spunbonded base web material consisting essentially of continuous man-made filaments, subjecting the spunbonded base web material to stretching in the cross direction to an extent of at least 5 percent of its original dimension but less than the cross direction elongation of the material under ambient temperature conditions at the time of stretching, stabilizing the base web material in its cross-stretched condition to provide a prestretched base web material substantially free from cross direction tensioning, applying a covering layer of fluid dispersible fibers, preferably in the form of one or more wet-laid wood pulp fibrous webs, to one surface of the relaxed prestretched base web to form a multilayer structure and subjecting the multilayer structure to hydroentanglement while in its relaxed condition to embed the covering fibers in the spunbonded base layer and affix the fiber layer to one surface of the prestretched base material. The resultant hydroentangled nonwoven spunbonded fabric exhibits improved dimensional stability and cross-directional strength characteristics closely approaching those in the machine direction.

A better understanding of the features and advantages of the invention can be obtained from the following detailed description that sets forth illustrative embodiments thereof and is indicative of the way in which the principles of the invention are employed. It is believed that these features and advantages will aid in understanding the process described herein, including the sequence of steps employed and the relation of one or more such steps with respect to each of the others, as well as resulting product possessing the desired features, characteristics, compositions, properties and relation of elements.

DESCRIPTION OF A PREFERRED EMBODIMENT

In accordance with the present invention, a nonwoven spun-bonded base web material is used as the initial component of the composite fabric. The base web is a prebonded web made from continuous man-made filaments and possesses a basis weight in the range of from 15 to 90 grams per square meter ($g/m^2$) with the preferred material having a basis weight of from 30 to 70 grams per square meter. The type of prebonding of the base material is not believed to be critical and may include solvent, needle or thermal bonding. The degree of prebonding achieved by the thermal bonding method will vary, with a bond area as low as 3 to 4 percent up to about 50 percent bond area. The preferred material generally has a bond area of about 5 to 25 percent. The polyolefin spunbonded webs typically use thermal bonding while the polyester spunbonded webs commonly employ needle bonding as well as thermal bonding systems.

Numerous commercially available spunbonded webs are presently available using different thermoplastic synthetic materials. The most extensively employed commercial materials are made from filaments of polyamides, polyesters and polyolefins such as polyethylene or polypropylene, although other filamentary materials such as rayon, cellulose acetate and acrylics may also be employed. Exemplary of the commercially available spunbonded base web materials that may be employed are the solvent bonded nylon filament materials sold under the trademark "Cerex", the lightly needle tacked polyester materials sold under the trademark "Reemay", and the thermal bonded polypropylene materials sold under the trademarks "Lutrasil" and "Celestra". Of course, other commercially available spunbonded base web materials also may be employed with good results.

In accordance with the present invention, the spunbonded base web material is initially cross-stretched or tentered by at least five percent of its original width and may be cross-stretched under heated conditions up to as much as 300 percent, although the operative range of cross-stretching does not generally exceed 150 percent of the original fabric width. The cross-stretching may be achieved on commercially available tentering equipment and preferably falls within the range of 15 to 80 percent. The degree of cross-stretching, of course, will vary with both the composition of the filaments and the prebonding system employed as well as with the weight of the base web material, since the lighter weight materials require less cross-stretching than the heavier weight materials in order to achieve the desired dimensional stability and uniformity of strength characteristics. For example, a base web having a basis weight of 30 $g/m^2$ may require a cross-stretch of only 15 percent to achieve the desired improvement in the MD/CD ratio while a base web of 45 $g/m^2$ may require 30 percent or more stretching.

After the material has been cross-stretched, it may be heated very briefly to heat set and stabilize the base web in its cross-stretched condition where the cross-stretching has occurred with little or no heating of the material. As will be appreciated, the cross-stretching can be carried out either with or without heating the base web material, but when the material is heated, the continuous filaments of thermoplastic material tend to become more pliable and cross-stretching to a greater extent is achieved. If the degree of cross-stretching desired is only about 15 to 45 percent, then heating during stretching may not be carried out and the material is thereafter heated for a very brief period of time to a heat set temperature. However, where cross-stretching takes place in conjunction with heating, the stretching may be 150 percent or more depending on the specific base web material utilized. In that instance, very little additional heating may be needed to stabilize the web in its stretched condition. As will be appreciated, the heat set or stabilizing temperature will vary with the composition of the spunbonded web, but typically falls within the range of about 300°-500° F. That temperature need only be applied for a brief period on the order of ten seconds or less and preferably only about 2 to 7 seconds for many materials.

After the cross-stretched, spunbonded base web material has been heat set so as to stabilize the material in its stretched condition, there is no need to maintain the web in its tensioned condition, and therefore it can be released from the cross-stretch tensioning or tentered environment. Thereafter, the cover layers are applied to the prestretched base web. The cover layers typically are composed predominantly of fluid dispersible fibers and can be applied to the base web either as loose fibers or, more preferably, as preformed tissue webs in either a single or multiple layer configuration. These tissue webs, preferably made from short paper-making fibers, are more easily handled in some situations than the loose short fibers. In any event, the short paper-making fibers typically have a fiber length of about 25 mm or less and most preferably from about 2–5 mm. Conventional paper-making fibers may include not only the conventional paper-making wood pulp fibers produced by the well-known kraft process, but also other natural fibers of conventional paper-making length. In accordance with the present invention, the amount of wood pulp used in the cover layer can vary substantially depending on the other components of the system, particularly the ability to exhibit the desired barrier properties in the resultant composite fabric. For this reason, generally it is preferred to employ 100 percent wood pulp, although mixtures or blends of fibers of various types and length may be employed. Included in such blends are long synthetic fibers that contribute to the ability of the fibrous web to undergo the entanglement process. The synthetic fiber component of the wet laid cover layer can consist of rayon, polyester, polyethylene, polypropylene, nylon or any of the related fiber-forming synthetic materials. The synthetic fiber may be of various lengths and deniers, although the preferred materials are typically about 10 to 25 mm in length and 1.0 to 3.0 denier per filament. As may be appreciated, longer fibers may be used where desired so long as they can be readily dispersed as a part of the cover layer.

In addition to the conventional paper-making fibers, the cover layer of the present invention may include other natural fibers that provide appropriate and desirable characteristics. Thus, in accordance with the present invention, long vegetable fibers may be used, particularly those extremely long, natural unbeaten fibers such as sisal, hemp, flax, jute and Indian hemp. These very long natural fibers supplement the strength characteristics provided by the bleach kraft and, at the same time, provide a limited degree of bulk and absorbency coupled with a natural toughness and burst strength. Accordingly, the long vegetable fibers may be deleted entirely or used in varying amount in order to achieve the proper balance of desired properties in the end product.

The paper-making fibers are preferably layered onto the substrate or base layer with no particular orientation of the fibers relative to the machine direction. Less uniform orientation of the fibers is therefore easily achieved by employing sheet material or a slurry of the paper-making fibers. Selection of the fibers is not critical, although, as mentioned, the wood pulp fibers are preferred. These wood pulp fibers, after introduction as a cover layer to the base web material, either in the form of loose fibers or as a preformed sheet material, will result in a multilayer structure consisting of the prestretched spunbonded base web material and one or more cover layers of the wood pulp sheets. These cover layers may take the form of one or two layers of tissue that may be applied to one or both sides of the base web material. Typically, the amount of fiber added to the base web will range from about 10 to 60 grams per meter with the preferred range being about 20 to 40 grams per square meter. The preferred wood pulp tissue material conveniently has a basis weight of about 20 $g/m^2$.

As will be appreciated, various fillers and other additives may be combined with the wood pulp cover layers to impart different desired properties to the resultant fabric. For example, where the end product is to be used in the medical field, it may be desirable to incorporate fillers having a biologically beneficial property. Materials such as molecular sieves or similar compounds that provide sites for attracting and retaining biological components may be incorporated in the cover layer to assist in maintaining the sterile nature of the environment in which the fabric is used. Of course, it will be appreciated that the extent of fillers should be kept to a minimum so as not to adversely impact on the softness, drape and feel of the resultant end product.

After assembly of the multilayer structure, it is subjected to a low to medium pressure hydroentanglement operation of the type described in the aforementioned Nozaki patent or the Viazmensky et al U.S. Pat. No. 5,009,747, the disclosures of which are incorporated herein by reference. This is achieved by passing the multilayer structure under a series of fluid streams or jets that directly impinge upon the top surface of the wood pulp cover layer with sufficient force to cause the short paper-making fibers to be propelled into and entangle with the stretched, spunbonded base web material. Preferably a series or bank of jets is employed with the orifices and spacing between the orifices being substantially as indicated in the aforementioned patents. The jets are operated at a pressure sufficient to provide limited displacement and entanglement of some of the wood pulp fibers, while providing a total energy input of about 0.07 to 0.4 hp-hr/lb, as described by the formula, $E=0.125\ YPG/bS$, wherein Y=the number of orifices per linear inch of manifold width, P=pressure in psig of liquid in the manifold, G=volumetric flow in cubic feet per minute per orifice, S=speed of the web material under the water jets in feet per minute and b=the basis weight of the fabric produced in ounces per square yard.

The total amount of energy, E, expended in treating the web is the sum of the individual energy values for each pass under each manifold, if there is more than one manifold or multiple passes. Generally, the total energy input is significantly less than the expended energy indicated in U.S. Pat. Nos. 3,485,705, 4,442,161 and 4,623,575 and slightly higher than that indicated in U.S. Pat. No. 5,009,747. In the preferred mode of operation, the total energy input is less than 0.3 hp-hr/lb and generally falls within the range of 0.1–0.25 hp-hr/lb.

While the hydroentangled composite fabric resulting from the foregoing operation exhibits substantially all of the operating characteristics required of such material, it is also frequently desirable to include further processing steps, such as the addition of appropriate material to control linting or to add a particular color or repellancy to the fabric. For example, a small amount of latex could be used to treat the hydroentangled spunbonded fabric to impart the appropriate coloration for medical applications as well as to reduce and control the lint and provide a minor amount of bonding. The control of linting can also be enhanced by employing slightly elevated total energy inputs during the hydroentangling operation. Other properties, such as the liquid barrier properties of the sheet material, may also be enhanced at this stage of the process through appropriate repellancy treatments. It, of course, must be kept in mind that the addition of latex to the material should be kept to well below 10 percent and preferably to about 5 percent or less so as to maintain the softness, feel and hand of the resultant nonwoven spunbonded fabric. In this connection, a latex addition of between 0.5 to 5.0 may be used with the preferred amount being from about 0.8 to 3.0 percent by weight. It will be appreciated that the hydroentanglement operation provides most, if not all, of the bonding requirements of the spunbonded fabric and the addition of latex is not undertaken for the purpose of achieving any significant bonding.

The resultant composite fabric exhibits substantially improved cross direction strength characteristics approaching equivalency in both the machine and cross directions. Thus, the strip and grab tensile strengths of the fabric will evidence an MD/CD ratio of less than 1.2:1. Although a ratio of precisely 1:1 is seldom achieved as a practical matter, a ratio within the range of about 1.2:1 to 0.8:1 is a reasonable target ratio with the preferred ratio range being 0.9 to 1.1:1. Of course, it should be kept in mind that the MD/CD ratio is only one measure of the improvement evidenced by the fabrics of this invention. Associated with this is the enhanced strength of the fabric in its weakest dimension as well as the improved moisture barrier characteristics for spunbonded materials. The cover layer does not add significantly to the strength of the fabric and therefore the improvement in cross direction characteristics results primarily from the cross stretching operation with minor amounts being contributed by the latex binder. The cross stretching also reduces the cross direction elongation, thereby providing improved dimensional stability. Even though there may be a reduction in machine direction strength, such a reduction does not adversely impact on the performance of the fabric.

The barrier properties of the fabric can be measured by the mason jar, the hydrostatic head and the impact penetration resistance test procedures. The mason jar test, INDA Standard Test Method 80.7a-70, determines the resistance of the fabric to penetration of water under a constant hydrostatic head and is reported as the time in minutes required for water penetration. It is generally preferred that the fabric exhibit mason jar values of about 100 minutes or more.

The hydrostatic head, AATCC Test Method 127-1977, measures the height in millimeters of a column of water which the sample material can support prior to water penetration. The undersurface of the sample is observed for leakage to detect the penetration. It determines the resistance of the fabric to water penetration under constantly increasing hydrostatic pressure. A column height in excess of 200 millimeters is considered desirable.

The impact penetration resistance test, TAPPI Test Method T402, measures the resistance of the sample fabric to the penetration of water by impact. It gives an indication of the amount of body fluid a fabric will permit to pass through the fabric as a result of a splash or spill. The water is allowed to spray from the height of two feet against the taut surface of the sample backed by a weighed blotter. The blotter is weighed after the test to determine water penetration. The preferred weight gain is less than five grams.

The grab tensile, TAPPI T494, measures the load in grams at the break point in a constant rate of extension tester. Instron grips clamp the sample and separate at a constant rate.

In order that the present invention may be more readily understood, it will be further described with reference to the following specific examples which are given by way of illustration only and are not intended to limit the practice of the invention.

EXAMPLE 1

Two polyester spunbonded web materials having different basis weights and sold under the trademarks "Reemay 2817" and "Reemay 5200" were used as the base webs. These materials, labelled Samples A and D, had been prebonded using a lightly needled tack and exhibited the properties set forth in Table I.

These materials were subjected to cross-stretching at different cross-stretching levels, namely 15 percent and 30 percent. After completion of the cross-stretching, the materials were heated to 300° F. for five seconds to heat set the materials in their extended positions and then all cross direction tensioning was removed.

Two layers of tissue made from 100% softwood and each having a basis weight of 20 grams per square meter were then placed on one surface of the stretched spunbonded material and subjected to hydroentanglement by passing the multilayer structures under water jets at 400 PSIG at a line speed of 37 feet per minute. The material was supported on an 86 mesh polyester screen and was subject to three passes under the water jets to provide a total energy input of 0.102 hp-hr/lb. The resultant fabrics were treated with a fluorocarbon water repellent finish. The properties of the treated materials are set forth in Table I as Samples B, C, F and G.

As will be noted from the data in Table 1, the stretched hydroentangled materials exhibit a significant improvement in cross direction properties and squareness.

TABLE I

| | Sample | | | | | |
|---|---|---|---|---|---|---|
| | A | B | C | D | E | F |
| Cross-stretch (%) | 0 | 15 | 30 | 0 | 15 | 30 |
| Basis Weight (g/m$^2$) | 43.6 | 84.8 | 81.2 | 63.8 | 107.9 | 110.7 |
| Grab tensile (g) | | | | | | |
| MD | 9525 | 12850 | 12200 | 16625 | 19150 | 18150 |
| CD | 7512 | 12550 | 11850 | 14700 | 17750 | 19500 |
| MD/CD | 1.27 | 1.02 | 1.03 | 1.13 | 1.08 | 0.93 |
| Elongation (%) | | | | | | |
| MD | 88.5 | 75 | 64 | 101 | 62 | 80 |
| CD | 108 | 85 | 77 | 120 | 89 | 88 |
| Elmendorf tear (g) | | | | | | |
| MD | * | * | * | * | * | * |
| CD | * | * | * | * | * | * |
| Mullen (g/cm$^2$) | 1969 | 2478 | 2531 | 3279 | 3374 | 3866 |
| Impact Penetration (g) | | 0.4 | 0.3 | | 0.7 | 0.4 |
| Mason jar (min) | | 120 | 120 | | 120 | 120 |
| Hydrostatic head (mm) | | 331 | 248 | | 340 | 340 |

TABLE I-continued

| | Sample | | | | | |
|---|---|---|---|---|---|---|
| | A | B | C | D | E | F |
| Energy (hp-hr/lb) | | .102 | .102 | | .102 | .102 |

*Reading off scale.

EXAMPLE 2

A polypropylene spunbonded web material having a point bond area of 22 percent and sold by Don and Low under the designation "S1040" was tentered at 275° F. to impart a 34 percent cross stretch and heat set as set forth in Example I. Properties of the material before and after tentering are set forth in Table II as Samples 2A and 2B respectively and evidence the improved squareness resulting from the cross-stretching.

Two layers of 20 g/m$^2$ wood pulp tissue were placed on one side and hydroentangled into the base web using a total energy input of 0.0864 hp-hr/lb at a line speed of 30 ft/min. The fabric was treated with a latex, color and repellancy mix at a pickup of 2.3 percent and the fabric was cured by passing it over steam heated drier cans at 75 ft/min. The properties of the resultant composite fabric is set forth in Table II as Sample 2C.

The above procedure was repeated except that a higher energy input of 0.150 hp-hr/lb was employed and the mix pickup was increased to 4.8 percent. The properties of the resultant fabric are set forth in Table II as Sample 2D.

EXAMPLE 3

Handsheets were produced using a polypropylene spunbond fabric as a base web. The polypropylene spunbond material was the same as that used in Example 2. The spunbond sheets were cross-stretched 33% in an air piston clamp-held tenter frame to reduce their basis weights to 30 grams per square meter.

TABLE II

| | Sample | | | |
|---|---|---|---|---|
| | 2A | 2B | 2C | 2D |
| Basis weight (gsm) | 40.7 | 27.7 | 73.2 | 73.3 |
| Thickness (microns) | 253 | 199 | 271 | 234 |
| Grab tensile (g) | | | | |
| MD | 12225 | 6813 | 11712 | 15743 |
| CD | 9775 | 6375 | 12162 | 15322 |
| MD/CD | 1.25 | 1.06 | .96 | 1.03 |
| Elongation (%) | | | | |
| MD | 151 | 45 | 51.7 | 59.6 |
| CD | 129 | 34 | 55.3 | 54.5 |
| Toughness (cm · g/cm$^2$) | | | | |
| MD | 1494 | 315 | 614 | 845 |
| CD | 978 | 257 | 454 | 550 |
| Elmendorf tear (g) | | | | |
| MD | >1600 | >1600 | 776 | 325 |
| CD | >1600 | 784 | 752 | 536 |
| Mullen (g/cm$^2$) | 1462 | 1916 | 2425 | 2540 |
| Water Head (mm) | — | — | 262 | 207 |
| Mason Jar (min) | — | — | 120 | 120 |
| IPR (g) | — | — | 1.5 | 4.4 |

The air pressure used to drive the pistons was 25 psig. A commercial hair blow drier having an output temperature of about 300° F. was directed at the fabric surface to heat the material, allowing it to relax and stretch without tearing as tension was applied to the fabric held in the clamps.

The cross-stretched polypropylene spunbond material was then hydroentangled with two 20 grams per square meter sheets of 100 percent softwood pulp. The hydroentanglement was performed by passing the three layers under a hydraulic entanglement manifold at a nozzle-to-web distance of ¾ inch and a speed of 37 feet per minute. The manifold was operated for two passes at 400 psig, two passes at 600 psig, and one pass at 800 psig for a total of five passes. Using a nozzle strip with 0.0036 inch holes spaced 0.5 millimeters apart and entangling on a 100 mesh plan weave polyester belt, the total energy applied to the sheet with 0.277 hp-hr/lb.

After hydroentanglement, the handsheet was padder treated with two chemical dips. The first dip applied a formaldehyde-free hydrophobic latex binder system. The second dip contained a fluorocarbon water repellant finish. The fabric was then cured at 275° F. for two minutes. The resultant fabric properties are presented in Table III.

TABLE III

| | |
|---|---|
| Basis Weight (gsm) | 78.5 |
| Thickness (microns) | 313 |
| Mullen Burst (g/cm$^2$) | 2409 |
| Strip Tensile (g/25 mm) | |
| MD | 3381 |
| CD | 3258 |
| MD/CD | 1.04 |
| Elongation (%) | |
| MD | 65 |
| CD | 59 |
| Toughness (cm-g/cm$^2$) | |
| MD | 679 |
| CD | 535 |
| Grab Tensile (g) | |
| MD | 11225 |
| CD | 11800 |
| MD/CD | 0.95 |
| Elmendorf Tear (g) | |
| MD | 796 |
| CD | 772 |

EXAMPLE 4

The procedure of Example 3 was repeated except that the polypropylene spunbond base web was replaced with a needled polyester spunbond material sold under the tradename "Reemay 5150". The polyester material was heated to slightly above 400° F. and cross stretched 34 percent using the previously described equipment. The properties of the material before and after tenter are set forth in Table IV as Sample 4A and 4B respectively. The same tissue, chemicals and pickups, and hydroentanglement process parameters discussed in Example 3 were used to complete the composite fabric. Representative properties are presented in Table IV as Sample 4C.

EXAMPLE 5

The procedure of Example 4 was repeated except that the polyester spunbonded material was stretched to a greater degree, namely 58%, at a stretching temperature of 420° F. The properties of the material before and after tenter stretching are set forth in Table V as Samples 5A and 5B respectively. The same tissue, chemicals and pickups and hydroentanglement process parameters were used to complete the composite fabric. Representative properties of the composite are presented in Table V as Sample 5C.

TABLE IV

| | Sample | | |
|---|---|---|---|
| | 4A | 4B | 4C |
| Basis Weight (gsm) | 46.3 | 31.7 | 77.6 |
| Thickness (microns) | 213 | 186 | 257 |
| Strip tensile (g/25 mm) | | | |
| MD | 1232 | 1631 | 1620 |
| CD | 890 | 1862 | 1977 |
| MD/CD | 1.38 | 0.88 | 0.82 |
| Elongation (%) | | | |
| MD | 71 | 40 | 49 |
| CD | 85 | 44 | 71 |
| Toughness (cm · g/cm$^2$) | | | |
| MD | 239 | 209 | 337 |
| CD | 177 | 255 | 440 |
| Grab tensile (g) | | | |
| MD | 6375 | 6558 | 10450 |
| CD | 5825 | 6713 | 10050 |
| MD/CD | 1.09 | 0.97 | 1.04 |
| Elmendorf Tear (g) | | | |
| MD | 1418 | 1260 | >1600 |
| CD | 896 | 1208 | >1600 |
| Mullen burst (g/cm$^2$) | 1700 | 1626 | 1942 |
| Waterhead (mm) | — | — | 270 |
| Mason Jar (min) | — | — | 111 |
| Impact Penetration Resistance (g) | — | — | 1.2 |

TABLE V

| | Sample | | |
|---|---|---|---|
| | 5A | 5B | 5C |
| Basis Weight gsm | 46.1 | 27.4 | 70.8 |
| Thickness microns | 241 | 175 | 243 |
| Tongue Tear g | | | |
| MD | 2287 | 1375 | 1706 |
| CD | 1233 | 1319 | 1669 |
| MD/CD | 1.85 | 1.04 | 1.02 |
| Strip Tensile g/25 mm | | | |
| MD | 2681 | 1850 | 2606 |
| CD | 1131 | 2000 | 2862 |
| MD/CD | 2.37 | 0.92 | 0.91 |
| Elongation % | | | |
| MD | 94 | 50 | 36 |
| CD | 150 | 39 | 62 |
| Toughness cm · g/cm$^2$ | | | |
| MD | 650 | 324 | 365 |
| CD | 435 | 243 | 508 |
| Grab Tensile g | | | |
| MD | 10825 | 8700 | 10550 |
| CD | 8825 | 7275 | 9550 |
| MD/CD | 1.23 | 1.19 | 1.10 |
| Elmendorf g | | | |
| MD | * | 1376 | 1112 |
| CD | * | 1388 | 1572 |
| Mullen g/cm$^2$ | 1968 | 2060 | 2012 |

* = Too strong to tear

As will be apparent to persons skilled in the art, various modifications, adaptations and variations of the foregoing specific disclosure can be made without departing from the teachings of the present invention.

We claim:

1. A process of producing a hydroentangled nonwoven fabric of enhanced cross direction properties comprising the steps of:

a) providing a bonded, continuous man-made filament, nonwoven base web material;

b) cross-stretching said base web by at least 5 percent its original extent but less than the cross direction elongation of said material under ambient-temperature stretching conditions;

c) stabilizing the base web material in its cross-stretched condition and relaxing the stabilized base web material to provide a prestretched web substantially free of cross direction tension;

d) applying a layer of fluid dispersible fibers to one surface of the relaxed prestretched web to form a multi-layer structure; and e) subjecting said multi-layer structure to hydroentanglement while in its relaxed condition to affix the fibers to said one surface of the prestretched base web material.

2. The process of claim 1 wherein the cross-stretching is about 15 to 150 percent and the ambient-temperature stretching conditions include heating the base web.

3. The process of claim 1 wherein the cross-stretching is about 15 to 80 percent and the stabilizing includes heating the stretched base web for a brief period to heat set the stretched web.

4. The process of claim 1 wherein the man-made filaments are thermoplastic materials and the cross-stretching is carried out while heating the base web sufficiently to render the thermoplastic materials pliable during cross-stretching.

5. The process of claim 1 wherein the fluid dispersible fibers include short papermaking fibers and the layer of fibers has a basis weight of about 10 to 60 g/m$^2$.

6. The process of claim 5 wherein the layer of fluid dispersible fibers includes one or more wood pulp wet laid fibrous webs of tissue weight and the hydroentanglement is effected at a total energy input of 0.08 to 0.3 hp-hr/lb.

7. The process of claim 5 wherein the layer of fluid dispersible fibers includes a slurry of short papermaking fibers.

8. The process of claim 1 wherein the man-made filaments are composed of material selected from the group consisting of polyesters, polyolefins and polyamides, the cross-stretching is about 15 to 150 percent while heating the base web and the stabilizing includes heating the stretched base web for a brief period to heat set the stretched web.

9. The process of claim 1 wherein the cross-stretching is about 15 to 80 percent, the stabilizing includes heating the stretched base web for a brief period to heat set the stretched web, the layer of fluid dispersible fibers includes one or more wood pulp wet laid fibrous webs of tissue weight and the hydroentanglement is effected at a total energy input of 0.08 to 0.3 hp-hr/lb.

10. The process of claim 1 wherein the base web material has a basis weight in the range of 15–90 g/m$^2$, the cross-stretching is about 15 to 80 percent, the stabilizing includes heat setting the stretched web, the layer of fluid dispersible fibers includes fillers, and the process includes treating the hydroentangled composite with a latex binder and a water repellant.

11. A hydroentangled composite nonwoven fabric of enhanced cross-directional properties comprising a bonded nonwoven base web material of continuous man-made filaments having a basis weight of 15–90 g/m$^2$, said base web being characterized by having been stretched in the cross direction by at least 5 percent its original extent but less than the cross direction elongation of web material under ambient-temperature stretching conditions, said base web being stabilized in its cross-stretched condition, and a cover layer of fluid dispersible fibers overlying one surface of said base web material and intimately hydroentangled therewith, said composite fabric having strength characteristics approaching equivalency in both the machine and cross directions.

12. The composite fabric of claim 11 wherein the cover layer has a basis weight of 10–60 g/m$^2$.

13. The composite fabric of claim 11 having a tensile strength MD/CD ratio of less than 1.2:1.

14. The composite fabric of claim 11 wherein the MD/CD ratio is within the range of 0.8:1 to 1.2:1 and the fabric exhibits moisture barrier and softness properties comparable to spunlaced material.

15. The composite fabric of claim 11 wherein the man-made filaments are composed of a thermoplastic material and the cover layer of fluid dispersible fibers includes one or more wood pulp fibrous webs hydroentangled to the base web.

16. The composite fabric of claim 11 wherein the man-made filaments are selected from the group consisting of polyesters, polyolefins and polyamides.

17. The composite fabric of claim 1 wherein the fabric exhibits moisture barrier properties including a mason jar value of at least 100 minutes according to INDA Standard Test 80.7a-70, a hydrostatic head of at least 200 millimeters according to AATCC Standard 127 and an impact penetration resistance of less than 5 grams according to TAPPI Standard T402.

18. The composite fabric of claim 11 wherein the fluid dispersible fibers are predominantly short papermaking fibers and the cover layer has a basis weight of about 10–60 g/m$^2$.

19. The composite fabric of claim 11 wherein the fluid dispersible fibers are 100 percent wood pulp fibers and the fabric includes up to 10 percent by weight of a latex binder and a filler having biologically beneficial properties.

20. The composite fabric of claim 11 wherein the cross-stretch is about 15 to 80 percent and the base web has been heat set to effect stabilization.

* * * * *

UNITED STATES PATENT AND TRADEMARK OFFICE

CERTIFICATE OF CORRECTION

PATENT NO. : 5,151,320

DATED : Sep. 29, 1992

INVENTOR(S) : Hamonoff et al

It is certified that error appears in the above-identified patent and that said Letters Patent is hereby corrected as shown below:

Column 14, line 1, change "claim 1" to -- claim 11 --.

Signed and Sealed this

Ninth Day of November, 1993

*Attest:*

*Attesting Officer*

BRUCE LEHMAN

*Commissioner of Patents and Trademarks*